United States Patent [19]

Coda

[11] 4,213,259

[45] Jul. 22, 1980

[54] WALL-MOUNTED DISPLAYS

[76] Inventor: Alfred Coda, 48 Wyandemere Dr., Woodcliff Lake, N.J. 07675

[21] Appl. No.: 961,545

[22] Filed: Nov. 17, 1978

[51] Int. Cl.[2] ..... G09F 1/12; G09F 7/20

[52] U.S. Cl. ..... 40/152.1; 40/124.1; 248/459; 248/495

[58] Field of Search ..... 40/152.1, 152, 156, 40/155, 154, 158 R, 153, 158 B, 209, 606, 617, 124.1, 10 R; 248/496, 467, 174, 489, 495, 497, 459

[56] References Cited

U.S. PATENT DOCUMENTS

| | | | |
|---|---|---|---|
| 2,583,129 | 1/1952 | Worth | 248/467 X |
| 2,652,647 | 9/1953 | Suciu | 40/152.1 X |
| 3,384,987 | 5/1968 | Prechtl | 40/152.1 |
| 3,565,489 | 2/1971 | Eirinberg et al. | 40/587 X |
| 3,784,150 | 1/1974 | Kulicke | 248/496 |
| 3,928,931 | 12/1975 | Slemmons | 40/152.1 |

*Primary Examiner*—John F. Pitrelli

*Attorney, Agent, or Firm*—Samuelson & Jacob

[57] ABSTRACT

A display is mounted on a wall at a selected distance from the wall by means of a spacer erected from a sheet of material, which normally is flat for storage and transportation, into a partially tubular member of selected axial length which is secured at one end thereof to the display and bears against the wall at the other end to space the display away from the wall. The spacer is included in a kit having a mounting board with an obverse surface receiving the item to be displayed and a reverse surface for receiving the one end of the tubular member.

16 Claims, 8 Drawing Figures

WALL-MOUNTED DISPLAYS

The present invention relates generally to the display of items, such as pictures, and pertains, more specifically, to wall mounting an item in a display, such as a picture frame, a plaque or the like, with the display spaced a selected distance from the wall.

The traditional methods and devices for displaying pictures, prints, photographs, certificates, documents, clippings, posters and like items of interest in picture frames and wall plaques recently have given way to a wide variety of more contemporary approaches to the display of such items. One approach which has been found to be aesthetically appealing is to mount a display on a wall, but spaced at a selected distance away from the wall. By selecting various distances among items in a group, an added dimension of depth can be achieved for a greater variety of aesthetic effects.

It is an object of the present invention to provide means by which items can be wall mounted for display at a selected distance from the wall.

Another object of the invention is to provide a kit of component parts which are assembled readily by persons of ordinary skill to establish a display for mounting an item at a selected distance from a wall.

Still another object of the invention is to provide a simplified spacer for placement between a display and the wall upon which the display is mounted for spacing the display at a selected distance from the wall.

A further object of the invention is to provide a kit employing a spacer of the type described in a compact form for ease of storage and transportation and which easily is erected for use.

A still further object of the invention is to provide a kit of the type described which is economical to fabricate in large numbers of uniform high quality and is readily employed in a wide variety of applications.

Yet another object of the invention is to provide means by which persons of ordinary skill may obtain a variety of contemporary aesthetic effects in the display of various items with ease and at relatively low cost.

The above objects, as well as still further objects and advantages, are attained by the present invention which may be described briefly as a mounting kit for wall mounting an item in a display, such as a picture frame, a plaque and the like, with the display spaced a selected distance from the wall, the kit comprising: a mounting board having an obverse surface for receiving the item to be displayed, and an opposite reverse surface; a sheet of material which normally is flat for storage and transportation and is capable of being erected into at least a partially tubular member having axially opposite ends; and means for securing one of the opposite ends of the tubular member to the reverse surface of the mounting board such that the sheet of material is maintained in the erected tubular state, and the other of the opposite ends is spaced axially from the reverse surface for bearing against the wall to space the mounting board axially away from the wall.

The invention will be more fully understood, while still further objects and advantages will become apparent, in the following detailed description of embodiments of the invention illustrated in the accompanying drawing, in which.

Figure 1:
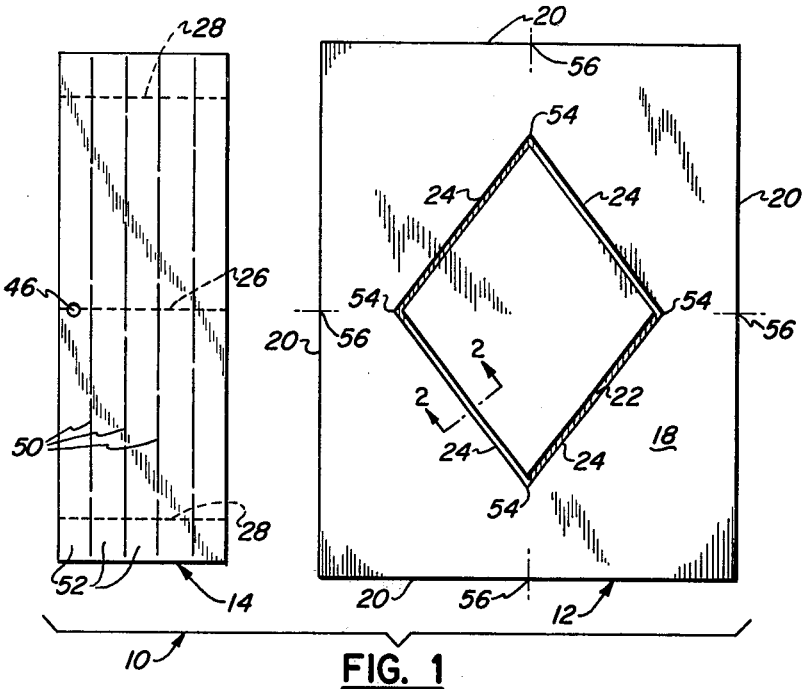
FIG. 1 is a plan view of component parts of a kit constructed in accordance with the invention.
Figure 2:
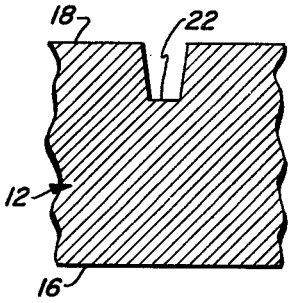
FIG. 2 is an enlarged, fragmentary cross-sectional view taken along line 2—2 of FIG. 1.

Referring now to the drawing, and especially to FIGS. 1 and 2 thereof, a mounting kit constructed in accordance with the invention is shown at 10. Mounting kit 10 includes component parts for displaying an item which is to be mounted on a wall at a selected distance from the wall, as will be described in detail below. Among the component parts of mounting kit 10 are a mounting board 12 which will receive the item to be mounted and a sheet 14 which will be erected into a spacer for spacing the mounting board the selected distance from the wall.

Mounting board 12 may be constructed of any one of a variety of relatively rigid, light-weight materials, such as wood, paper compositions, cork or one or more of several synthetic resin materials. The mounting board 12 has an obverse surface 16 and an opposite, reverse surface 18, both of which extend between the four sides 20 of the rectangular configuration of mounting board 12. A groove 22 is provided at the reverse surface 18 and follows a diamond-shaped plan configuration having four legs 24, for purposes which will be explained below.

Sheet 14 is constructed of a semi-rigid material such as paper card stock or a synthetic resin material having characteristics which enable the sheet 14 to be placed in the kit 10 in a flat configuration, as seen in FIG. 1, for ease of packaging for storage and transportation. Preferably, the area of the sheet 14 is no more than the area of the mounting board 12 so that both will fit readily within a package no larger than the length and width of the mounting board. Sheet 14 is provided with a central fold line 26 and further fold lines 28 spaced laterally from fold line 26 at either side thereof and extending parallel thereto. Fold lines 26 and 28 are embossed or scored in sheet 14.

Figure 3:
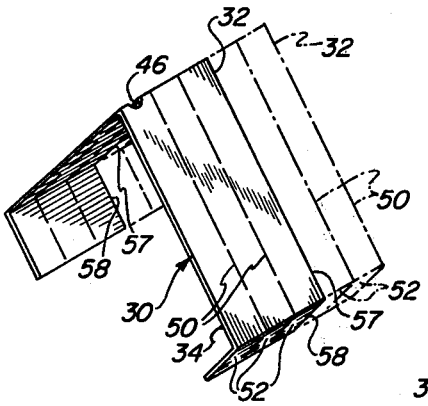
FIG. 3 is a perspective view of a component part of the kit, erected for assembly.

As best seen in FIG. 3, sheet 14 is folded along fold lines 26 and 28 to erect the sheet into a partially tubular member 30 having a partial diamond-shaped cross-sectional configuration complementary to the diamond-shaped plan configuration of groove 22 in reverse surface 18 of mounting board 12. Tubular member 30 has opposite ends 32 and 34 spaced apart axially, and fold lines 26 and 28 extend axially along tubular member 30.

Figure 4:
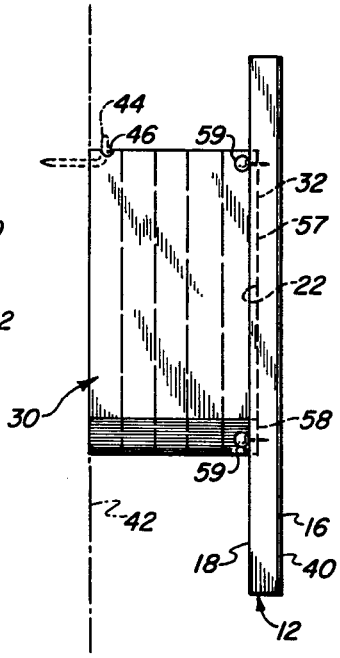
FIG. 4 is a side elevational view of a wall-mounted display constructed from the kit.

Turning now to FIG. 4, the item to be displayed, in this instance, is a photograph 40 which has been affixed to mounting board 12 by laminating or adhering the photograph 40 to the obverse surface 16 of the mounting board. End 32 of tubular member 30 is then inserted into the groove 22 at the reverse surface 18 of the mounting board. The partial diamond-shaped cross-sectional configuration of tubular member 30 at end 32 and the complementary relationship between the thickness of the tubular member 30 at end 32 and the width of groove 22 enables the end 32 to be secured within the groove 22 by means of a frictional engagement of the end 32 within groove 22. The assembled mounting board 12 and tubular member 30 may then be mounted upon a wall 42 by means of a standard wall-attachment means shown in the form of a hanger 44 which is passed through a hanging aperture 46 located adjacent end 34 of the tubular member 30. End 34 will then bear against wall 42 with the tubular member 30 serving as a spacer to space the mounting board 12, and the photograph 40 carried thereby, away from the wall 42 by a distance determined by the axial length of tubular member 30.

The axial length of tubular member 30 may be changed in order to select the desired spacing between the photograph 40 and the wall 42. To this end, the sheet 14 is provided with guide lines 50 extending in a direction transverse to the axial direction and dividing the sheet into a plurality of segments 52. As illustrated in phantom in FIG. 3, any selected number of segments 52 may be removed, as by cutting along a chosen guide line 50, to obtain the desired axial length in tubular member 30. Guide lines 50 may be embossed or printed on sheet 14, to delineate visually the segments 52, or the sheet 14 may be perforated along the guide lines 50 to further facilitate the selected removal of segments 52.

It is noted that the orientation of the groove 22 relative to the mounting board 12, together with the configuration and peripheral extent of the tubular member 30, tend to provide a sufficient degree of integrity to the assembled mounting board 12 and tubular member 30 and a high degree of stability to the wall-mounted display. Thus, the diamond-shaped plan configuration of groove 22 is oriented relative to the rectangular shape of the mounting board 12 with the apices 54 of the diamond-shaped plan configuration aligned with the midpoint 56 of a corresponding side 20 of the rectangular configuration of the mounting board 12. The edge portions 57 of end 32 of tubular member 30 extend fully along two contiguous legs 24 of the groove 22 and further end edge portions 58 then continue along at least corresponding portions of the further two legs 24, thereby maintaining the rigid, semi-tubular structure of the tubular member 30 and providing the appropriate support for the hanging display. Since the legs 24 are all of equal length, the tubular member 30 may be inserted into groove 22 in any of four relative positions around the periphery of groove 22, thereby enabling any desired orientation of the photograph 40 on the wall 42.

Figure 5:
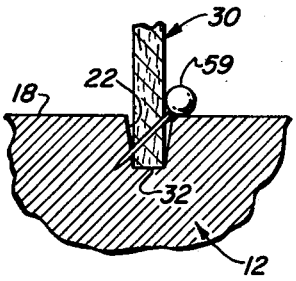
FIG. 5 is an enlarged, fragmentary cross-sectional view similar to FIG. 2, but with the component parts assembled.

In order to supplement the frictional engagement of the end 32 of tubular member 30 in groove 22, further securing means in the form of pins 59 are passed through the tubular member 12 adjacent end 32 and into the mounting board 12, as seen in FIGS. 4 and 5.

Figure 6:
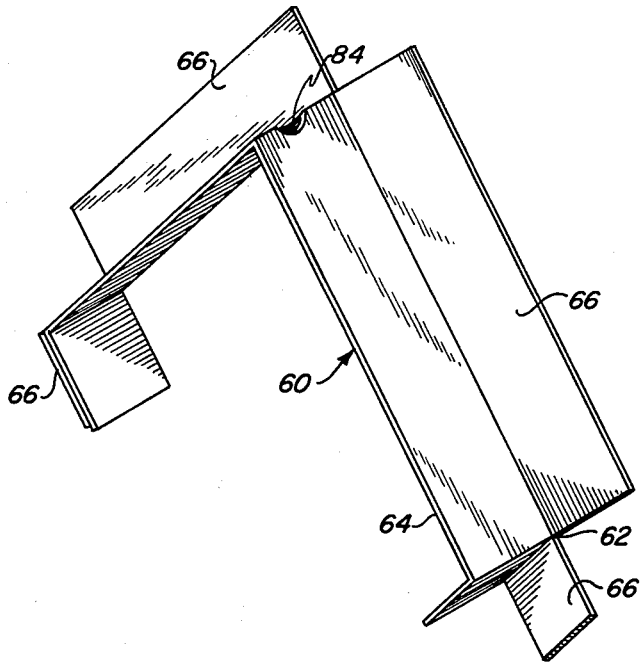
FIG. 6 is a perspective view of a component part of an alternate kit constructed in accordance with the invention.
Figure 7:
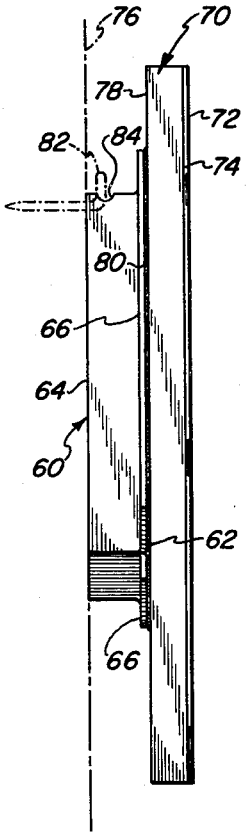
FIG. 7 is a side elevational view of a wall-mounted display constructed with the component part of FIG. 6.

Referring now to FIGS. 6 and 7, an alternate construction is shown for the spacer component of a kit constructed in accordance with the invention. Thus, in FIG. 6, an alternate tubular member 60 is shown already erected and extending between axially spaced opposite ends 62 and 64. Integral tabs 66 are provided at end 64 and are folded outwardly.

As seen in FIG. 7, a mounting board 70, with a photograph 72 affixed to the obverse surface 74 of the mounting board, is hung from a wall 76 by securing the tabs 66 to the reverse surface 78 of the mounting board 70 by means of an adhesive 80. A hanger 82 will extend through a hanging aperture 84 in the tubular member 60 to mount the assembly on the wall 76.

As in the earlier-described embodiment, tubular member 60 has a partial diamond-shaped cross-sectional configuration for rigidity and for providing stability in the hanging assembly. The use of adhesive attached tabs 66 enables the elimination of any groove in the reverse surface 78 of mounting board 70 and, further, allows the tubular member 60 to be oriented at any selected position relative to the mounting board 70.

Figure 8:
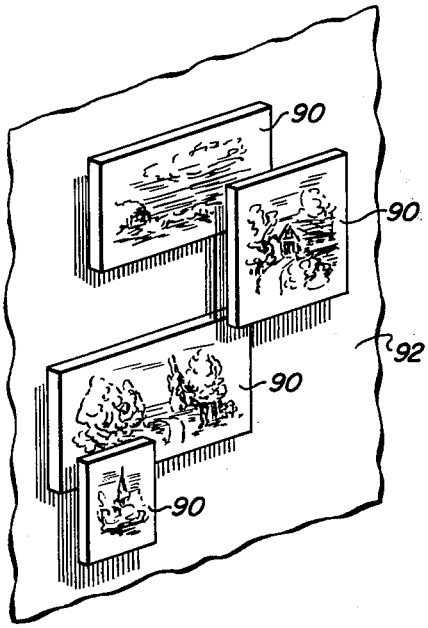
FIG. 8 is a pictorial view of an arrangement of a plurality of displays constructed in accordance with the invention.

Turning now to FIG. 8, a plurality of displays 90 are depicted in a three-dimensional arrangement in which the individual displays 90 are spaced at various selected distances from a wall 92, enabling the displays 90 to overlap and establish a coordinated, dimensional aesthetically pleasing grouping. Each of the displays 90 is constructed in accordance with the above description, utilizing spacers of various selected lengths to attain the desired spacing from wall 92. Hence, the present invention provides simplified means by which persons of ordinary skill can create a wide variety of aesthetically pleasing displays.

It is to be understood that the above detailed description of preferred embodiments of the invention are provided by way of example only. Various details of design and construction may be modified without departing from the true spirit and scope of the invention as set forth in the appended claims.

The embodiments of the invention in which an exclusive property or privilege is claimed are defined as follows:

1. A mounting kit for wall mounting an item in a display, such as a picture frame, a plaque and the like, with the display spaced a selected distance from the wall, said kit comprising:

a mounting board having an obverse surface for receiving the item to be displayed, and an opposite reverse surface;

a sheet of material which normally is flat for storage and transportation and is capable of being erected into at least a partially tubular member having axially opposite ends; and means for securing one of said opposite ends of the tubular member to the reverse surface of the mounting board such that the sheet of material is maintained in the erected tubular state, and the other of said opposite ends is spaced axially from the reverse surface for bearing against the wall to space the mounting board axially away from the wall, the means for securing one of said opposite ends of the tubular member to the reverse surface of the mounting board including a groove in the reverse surface of the mounting board, the groove following a diamond-shaped plan configuration and including legs of equal lengths; and an edge located along said one end of tubular member, the groove being complementary to the edge such that the edge is receivable within the groove, and the tubular member having at least a partial diamond-shaped cross-sectional configuration which, when inserted into the groove, extends fully along two contiguous legs thereof and at least partially along two further legs thereof.

2. The invention of claim 1 wherein the tubular member has fold lines at apices of the diamond-shaped cross-sectional configuration.

3. The invention of claim 2 wherein the fold lines include a central axial fold line and further fold lines spaced equal distances to either side of the central fold line and parallel thereto.

4. The invention of claim 1 wherein the sheet of material includes guide lines extending transverse to the axial direction and located at axially spaced positions along the tubular member to define a plurality of segments such that selected ones of the segments can be removed for selecting the overall axial length of the erected tubular member.

5. The invention of claim 1 wherein:

the mounting board has a four-sided rectangular shape; and the groove is oriented with the apices of the diamond-shaped plan configuration aligned with the mid-point of a corresponding side of the mounting board.

6. The invention of claim 1 wherein the means for securing one of said opposite ends of the tubular member to the reverse surface of the mounting board further includes pins for passing through the tubular member adjacent the one of said ends and into the mounting board.

7. The invention of claim 1 including wall-attachment means located adjacent the other of the opposite ends of the tubular member.

8. The invention of claim 7 wherein the wall-attachment means includes an aperture in the sheet.

9. A spacer for use in combination with a wall-mounted display to space the display a selected distance from the wall, the display having a groove therein, the groove following a diamond-shaped plan configuration and including legs of equal lengths, said space comprising:

a sheet of material which normally is flat for storage and transportation and is capable of being erected into at least a partially tubular member having axially opposite ends; and means for securing one of said opposite ends of the tubular member to the display such that the sheet of material is maintained in the erected tubular state, and the other of said opposite ends is spaced axially from the display for bearing against the wall to space the display axially away from the wall, the means for securing one of said opposite ends of the tubular member to the display including an edge located along said one end of the tubular member, the edge being receivable within the groove in the display; and the tubular member having at least a partial diamond-shaped cross-sectional configuration which, when inserted into the groove, extends fully along two contiguous legs thereof and at least partially along two further legs thereof.

10. The invention of claim 9 wherein the tubular member has fold lines at apices of the diamond-shaped cross-sectional configuration.

11. The invention of claim 10 wherein the fold lines include a central axial fold line and further fold lines spaced equal distances to either side of the central fold line and parallel thereto.

12. The invention of claim 9 or 10 wherein the sheet of material includes guide lines extending transverse to the axial direction and located at axially spaced positions along the tubular member to define a plurality of segments such that selected ones of the segments can be removed for selecting the overall axial length of the erected tubular member.

13. The invention of claim 9 wherein the means for securing one of said opposite ends of the tubular member to the display further includes pins for passing through the tubular member adjacent the one of said ends and into the display.

14. The invention of claim 1 or 13 including wall-attachment means located adjacent the other of the opposite ends of the tubular member.

15. The invention of claim 14 wherein the wall-attachment means includes an aperture in the sheet.

16. A mounting kit for wall mounting an item in a display, such as a picture frame, a plaque and the like, with the display spaced a selected distance from the wall, said kit comprising:

a mounting board having an obverse surface for receiving an item to be displayed, and an opposite reverse surface;

a sheet of material which normally is flat for storage and transportation and is capable of being erected into at least a partially tubular member having axially opposite ends, the tubular member having at least a partial diamond-shaped cross-sectional configuration with fold lines at apices of the diamond-shaped cross-sectional configuration, the sheet of material including perforated guide lines extending transverse to the axial direction and located at axially spaced positions along the tubular member to define a plurality of severable segments such that selected ones of the segments can be removed for selecting the overall axial length of the erected tubular member;

tabs integral with the sheet at one of said opposite ends of the tubular member; and an adhesive for securing the tabs to the mounting board so as to secure the tubular member to the reverse surface of the mounting board with the sheet of material maintained in the erected tubular state, and the other of said opposite ends spaced axially from the reverse surface for bearing against the wall to space the mounting board axially away from the wall.

* * * * *